US010267005B2

(12) United States Patent
Yoon et al.

(10) Patent No.: US 10,267,005 B2
(45) Date of Patent: Apr. 23, 2019

(54) EXCAVATING PUMP APPARATUS AND PILE INSTALLATION APPARATUS COMPRISING SAME

(71) Applicant: SAMSUNG HEAVY IND. CO., LTD., Seoul (KR)

(72) Inventors: Sang Joon Yoon, Geoje-si (KR); Byung Woo Kim, Geoje-si (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 0 days.

(21) Appl. No.: 15/508,467

(22) PCT Filed: Sep. 23, 2015

(86) PCT No.: PCT/KR2015/010004
§ 371 (c)(1),
(2) Date: Mar. 2, 2017

(87) PCT Pub. No.: WO2016/048025
PCT Pub. Date: Mar. 31, 2016

(65) Prior Publication Data

US 2017/0275844 A1 Sep. 28, 2017

(30) Foreign Application Priority Data

Sep. 24, 2014 (KR) ..... 10-2014-0127864

(51) Int. Cl.
*E02D 13/04* (2006.01)
*E02D 7/00* (2006.01)
(Continued)

(52) U.S. Cl.
CPC ..... *E02D 13/00* (2013.01); *E02D 5/24* (2013.01); *E02D 7/02* (2013.01); *E02F 5/006* (2013.01);
(Continued)

(58) Field of Classification Search
CPC ..... E02B 17/027; E02D 13/04; E02D 7/02; E02D 5/22; E02D 11/00; E02D 7/00;
(Continued)

(56) References Cited

U.S. PATENT DOCUMENTS 3,282,356 A * 11/1966 Paulson ..... E21B 7/00 173/164
3,454,119 A * 7/1969 McClinton ..... E21B 10/18 175/424
(Continued)

FOREIGN PATENT DOCUMENTS

JP 2007-107272 A 4/2007
KR 20-0274072 Y1 5/2002
(Continued)

OTHER PUBLICATIONS

International Search Report issued in corresponding application PCT/KR2015/010004 dated Nov. 24, 2015.

*Primary Examiner* — Benjamin F Fiorello
*Assistant Examiner* — Edwin J Toledo-Duran
(74) *Attorney, Agent, or Firm* — Knobbe Martens Olson & Bear LLP

(57) ABSTRACT

An excavating pump apparatus and a pile installation apparatus having the same are disclosed. An excavating pump apparatus in accordance with an embodiment of the present invention may include: an excavation head being inserted into an inner space of a pile through an open hole opening the inner space of the pile and being configured to crush seafloor sediments and allow the crushed seafloor sediments to be flowed therein; an outlet conduit connected to the excavation head and being a channel for discharging the seafloor sediments flowed into the excavation head to an outside of the pile; and a pump configured to move the
(Continued)

seafloor sediments through the outlet conduit by providing a pump pressure to the outlet conduit.

15 Claims, 12 Drawing Sheets

(51) Int. Cl.
*E02D 13/00* (2006.01)
*E02D 5/24* (2006.01)
*E02D 7/02* (2006.01)
*E02F 5/00* (2006.01)
*E02F 5/20* (2006.01)

(52) U.S. Cl.
CPC ..... *E02F 5/20* (2013.01); *E02D 2250/0061* (2013.01)

(58) Field of Classification Search
CPC .. E02D 5/44; E02D 23/00; E02D 5/56; E02D 7/22; E02D 5/72; E02D 5/38; B63B 21/26; E21B 41/08
USPC ..... 405/227, 228, 229, 231, 232, 238, 249, 405/252.1, 253, 255, 257
See application file for complete search history.

(56) References Cited

U.S. PATENT DOCUMENTS 3,502,159 A * 3/1970 Pogonowski ..... E02B 17/027 173/193
3,546,885 A * 12/1970 Pogonowski ..... E02B 17/00 405/227
3,674,100 A * 7/1972 Becker ..... E21B 7/20 175/135
3,921,410 A * 11/1975 Philo ..... E02D 5/226 175/84
4,171,176 A * 10/1979 Yamada ..... E04C 5/163 405/239
4,534,426 A * 8/1985 Hooper ..... E21B 21/00 175/65
4,818,149 A * 4/1989 Kuehn ..... E02D 7/02 173/1
4,904,119 A * 2/1990 Legendre ..... E02D 17/13 405/228
5,586,609 A * 12/1996 Schuh ..... E21B 17/18 175/215
9,080,389 B2 * 7/2015 Vandenbulcke ..... E21B 7/18
9,222,233 B2 * 12/2015 Peters ..... E02D 7/16
2003/0094308 A1 * 5/2003 Weixler ..... E02D 7/28 175/57
2003/0141111 A1 * 7/2003 Pia ..... E21B 7/208 175/57
2008/0226398 A1 * 9/2008 Gibberd ..... E02D 5/40 405/223
2012/0118644 A1 * 5/2012 Vandenbulcke ..... E21B 7/18 175/65
2014/0096966 A1 * 4/2014 Freitag ..... E21B 7/046 166/298
2014/0157963 A1 * 6/2014 Von Wirth ..... E02D 9/04 83/27

FOREIGN PATENT DOCUMENTS

KR 10-0947080 B1 3/2010
KR 10-1052146 B1 7/2011
KR 20-0473599 Y1 7/2014

* cited by examiner (a)

(b)

EXCAVATING PUMP APPARATUS AND PILE INSTALLATION APPARATUS COMPRISING SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application is a U.S. national phase application of PCT/KR2015/010004 filed on Sep. 23, 2015 that claims the benefit of Korean Patent Application No. 10-2014-0127864, filed Sep. 24, 2014, each of which is incorporated by reference herein in its entirety.

BACKGROUND

Technical Field

The present invention relates to an excavating pump apparatus and a pile installation apparatus including the same.

Related Art

A pile is installed in the seabed to provide ground foundation for a landing type structure installed on the seabed or to moor a floating type structure. These marine structures have been increasingly bigger and installed in the deeper sea.

The abysmal seafloor ground has a relatively stronger accumulation layer than a shallow sea, and a suction pile is usually constructed as a foundation structure for a soft ground. The suction pile is often used as a foundation for a coastal breakwater and is frequently used as a foundation for the seabed structure of deep sea oil field or as an anchor pile for mooring a floating type structure.

The suction pile construction method is performed by forcing out the water in the pile, adding the pressure difference between the inside and outside of the pile caused by the forcing out of the water to the weight of the pile itself, and allowing the pile to dig into the seabed. It is known that the greater the diameter of the suction pile, the easier the intrusion is with a small pressure difference.

Nonetheless, increasing the diameter of the pile too much for a greater supporting force results in an exponential increase in costs for manufacturing, transporting and installing the large pile.

KR Utility Model 20-0274072 (SUCTION PILE WITH FLANGE) discloses a suction pile with a lowered installation cost and improved support capability.

FIG. 1 is a perspective view showing the suction pile with flange.

FIG. 1 is illustrated with a circular flange 10, a suction hole 11, injection holes 12, an annular plate 13, outlet holes 14 and a pile 20.

According to this configuration, while the portion of the pile being injected has a relatively small diameter, a large flange is attached over the pile, complementing the shortcoming of the pile being tilted when the injection is completed.

Except the outlet holes, the suction pile shown in FIG. 1 has a basic structure in which the inside and the outside of the pile are completely shielded. Nevertheless, sinking by weight of the pile has little effect in injecting the pile into the seafloor ground, where a firm sedimentary layer or sandy component is predominant, despite a suction pressure, thereby inevitably requiring a pile driving method using an underwater hammer.

The inventor of the present invention has either possessed the above-described related art for deriving the present invention or obtained the above-described related art while deriving the present invention, and the above-described related art may not necessarily have been publicly available prior to the filing of the present invention.

SUMMARY

The present invention provides an excavating pump apparatus facilitating rapid injection and installation of a pile, hence saving construction costs, by discharging seafloor sediments that are liquefied by disturbing the firm sedimentary layer or sandy seafloor ground preventing the injection of the pile.

The present invention also provides an excavating pump apparatus that allows crushed seafloor sediments to be flowed into a head frame through an excavating hole penetrating the head frame below an excavation bit or through an additional inlet that is not connected with the excavation bit and is designed for easy replacement of damaged/worn-out excavation bits Other objects of the present invention will be understood through the below description.

An aspect of the present invention provides an excavating pump apparatus, including: an excavation head being inserted into an inner space of a pile through an open hole opening the inner space of the pile and being configured to crush seafloor sediments and allow the crushed seafloor sediments to be flowed therein; an outlet conduit connected to the excavation head and being a channel for discharging the seafloor sediments flowed into the excavation head to an outside of the pile; and a pump configured to move the seafloor sediments through the outlet conduit by providing a pump pressure to the outlet conduit.

The excavation head may include: a head frame having a shape of a cone of which an inside is hollow and having a plurality of excavation bits installed on an outer surface thereof, the excavation bits functioning as inflow paths of the seafloor sediments; and a center tube being vertically supported by support fixture in the head frame and having a middle portion penetrated to be connected with the outlet conduit.

The excavating pump apparatus may further include a plurality of bracing or casing, each having a top portion thereof being attached to the center tube and a bottom portion thereof being attached to a boundary of a top surface of the head frame.

The head frame may have a plurality of rectangular parallelepiped shaped installation grooves installed on the outer surface thereof, the installation grooves being installed spirally or arranged corresponding to generators arranged at regular intervals, the installation grooves being provided with inlet holes connected with the inside of the head frame, and the excavation bits may be inserted and installed in the installation grooves, respectively.

The excavation bits may each include a fixing portion, being inserted and fixed in the installation groove, and an excavating portion, being protruded out of the installation groove, and the excavating portion and the fixing portion may have an inflow space provided therein, the inflow space having a V-shaped groove formed successively, and the crushed seafloor sediments may be flowed in through an excavating hole located at an entrance side, moved along the inflow space, and flowed into the head frame through the inlet hole located at the exit side.

The slopes of the excavation bits on either side of the V-shaped groove may become gradually slower.

The excavation head may include: a head frame having a shape of a cone of which an inside is hollow, having a plurality of inlet holes formed on an outer surface thereof, the inlet holes functioning as inflow paths of the seafloor sediments, and having a plurality of replaceable excavation bits protruded on the outer surface thereof, the excavation bits being configured to perform a crushing function; and a center tube being vertically supported by support fixture in the head frame and having a middle portion penetrated to be connected with the outlet conduit.

A plurality of fitting grooves may be recessed in between the inlet holes, the fitting grooves being formed spirally or arranged corresponding to generators arranged at regular intervals, and a fitting protrusion protruded on one surface of a bit body of each of the excavation bits may be fitted into the fitting groove.

The excavating pump apparatus may further include a support frame being coupled to the excavation head or the outlet conduit and configured to be expanded in radial directions of the excavation head or the outlet conduit to press an inner circumferential surface of the pile so as to restrict a horizontal movement of the excavation head in the inner space of the pile.

The support frame may include: a plurality of rods being rotatably coupled to the excavation head or the outlet conduit for opening or folding from the excavation head or the outlet conduit; and a roller portion being coupled to an end of each rod and making contact with the inner circumferential surface of the pile.

Another aspect of the present invention provides a pile installation apparatus, including: a pile having a hollow space formed therein and configured to be injected into a seafloor ground; and an excavating pump apparatus being inserted into the hollow space so as to allow the pile to be injected into the seafloor ground, wherein the excavating pump apparatus includes: an excavation head configured to crush seafloor sediments and allow the crushed seafloor sediments to be flowed therein; an outlet conduit connected to the excavation head and being a channel for discharging the seafloor sediments flowed into the excavation head to an outside of the pile; and a pump configured to move the seafloor sediments through the outlet conduit by providing a pump pressure to the outlet conduit.

Here, the pile may include: a pile portion having a shape of a circular tube; and a flange portion formed at an upper portion of the pile portion so as to disperse a load exerted to the pile portion to a seafloor surface.

The pile may include: a pile portion having a shape of a circular tube; a support plate being formed with a hollow space into which the pile portion is inserted and being radially extended from the pile portion such that a contact area in the seafloor ground is increased when injected into the seafloor ground; and stopper portions being protruded at either lengthwise end of the pile portion so as to prevent the support plate from being detached from the pile portion.

The pile installation apparatus may further include a pile driving socket installed at an upper end of the pile so as to facilitate further injection of the pile by pile-driving, and the pile driving socket may have an opening formed at a lateral surface thereof, the outlet conduit passing through the opening.

Other aspects, features and advantages of the present invention will become apparent through the below detailed description, drawings and claims.

According to a certain embodiment of the present invention, a pile can be rapidly injected and installed, hence saving construction costs, by discharging seafloor sediments that are liquefied by disturbing the firm sedimentary layer or sandy seafloor ground preventing the injection of the pile.

Moreover, crushed seafloor sediments are allowed to be flowed into a head frame through an excavating hole penetrating the head frame below an excavation bit or through an additional inlet that is not connected with the excavation bit, and damaged/worn-out excavation bits can be easily replaced

DETAILED DESCRIPTION

Figure 1:
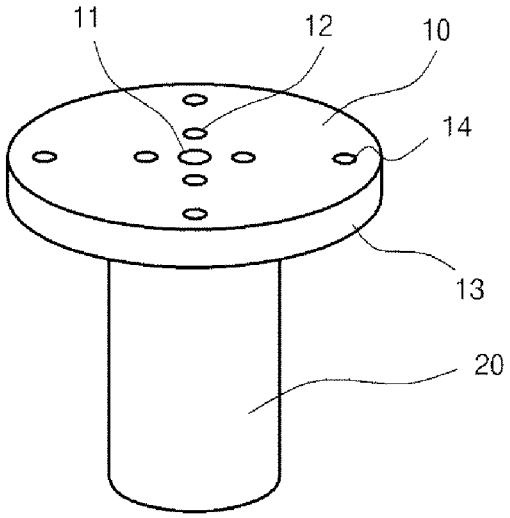
FIG. 1 is a perspective view showing the suction pile with flange.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the ideas and scope of the present invention.

When one element is described as being "connected" or "accessed" to another element, it shall be construed as being connected or accessed to the other element directly but also as possibly having another element in between. On the other hand, if one element is described as being "directly connected" or "directly accessed" to another element, it shall be construed that there is no other element in between.

The terms used in the description are intended to describe certain embodiments only, and shall by no means restrict the present invention. Unless clearly used otherwise, expressions in a singular form include a meaning of a plural form. In the present description, an expression such as "comprising" or "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Terms such as "first" and "second" can be used in describing various elements, but the above elements shall not be restricted to the above terms. The above terms are used only to distinguish one element from the other.

Moreover, any term including "unit," "part," "portion" or "unit" in the description refers to a unit for processing at least one function or operation and may be realized through hardware, software or a combination thereof.

Elements of an embodiment described with reference to the accompanying drawings are not necessarily restricted to the described embodiment, and may be included in another embodiment within the technical ideas and scope of the present invention. Moreover, even if a particular description is omitted, it shall be appreciated that a new embodiment is possible by combining a plurality of embodiments.

In describing certain embodiments with reference to the accompanying drawings, identical or corresponding elements will be given the same reference numerals, regardless of the figure number, and any redundant description of the identical or corresponding elements will not be repeated. Throughout the description of the present invention, when describing a certain relevant conventional technology is determined to evade the point of the present invention, the pertinent detailed description will be omitted.

Figure 2:
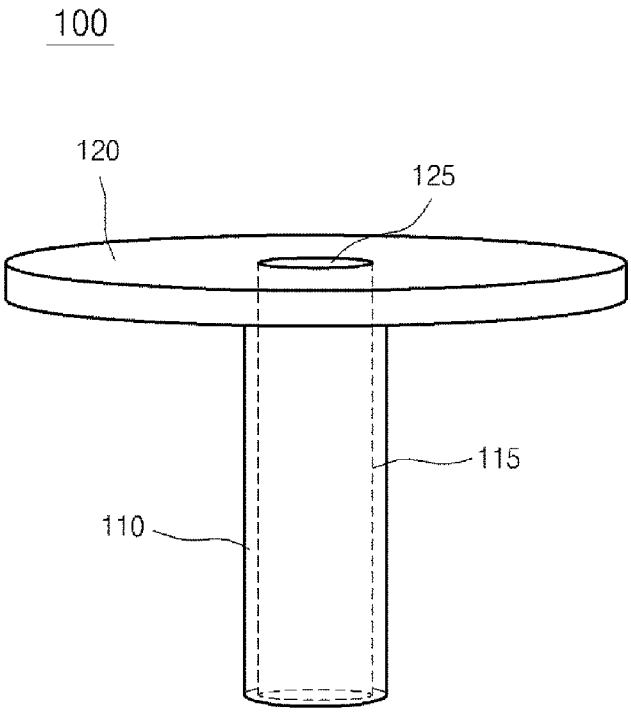
FIG. 2 is a perspective view showing a pile having a large flange in accordance with an embodiment of the present invention.

FIG. 2 is a perspective view showing a pile having a large flange in accordance with an embodiment of the present invention.

Illustrated in FIG. 2 are a pile 100, a pile portion 110, a flange portion 120, an open hole 125 and an inner space 115.

The pile 100 having a large flange in accordance with an embodiment of the present invention is characterized by being injected into the seafloor in a short time by use of an apparatus for excavating the seafloor ground being inserted in the pile, instead of using a suction method.

The pile 100 having a large flange in accordance with an embodiment of the present invention includes the pile portion 110, which is the body portion of the pile 100, and the flange portion 120, which has a large support plate formed at an upper portion of the pile portion 110.

The circular-shaped flange portion 120, having a diameter much larger than that of the pile portion 110, is installed at a top end of the pile portion 110. For example, the diameter of the flange portion 120 may be approximately 3 times or greater than that of the pile portion 110. (D1 (diameter of pile portion)<<D2 (diameter of flange portion))

The flange portion 120 having the large diameter functions to disperse a load applied to the pile portion 100 to the seafloor and prevents the pile 100 from being tilted by a partial load.

The pile portion 110 has a tube shape in which an inside thereof is hollow. In other words, the pile portion 110 has the inner space 115 with a predetermined diameter.

Unlike FIG. 1, the flange portion 120 is not structured to be completely shielded to discharge the seawater. Rather, the flange portion 120 has the open hole 125 formed therein for allowing the hollow inner space 115 of the pile portion 110 to be completely open. At the same time, by allowing the diameter of the flange portion 120 to be much bigger, the fixing force can be increased after injecting the pile.

Hereinafter, a method of injecting the pile 100 having the structure shown in FIG. 2 into the seabed will be described, and a detailed structure of an excavating pump apparatus for injecting the pile 100 will be described with reference to relevant drawings.

Figure 3:
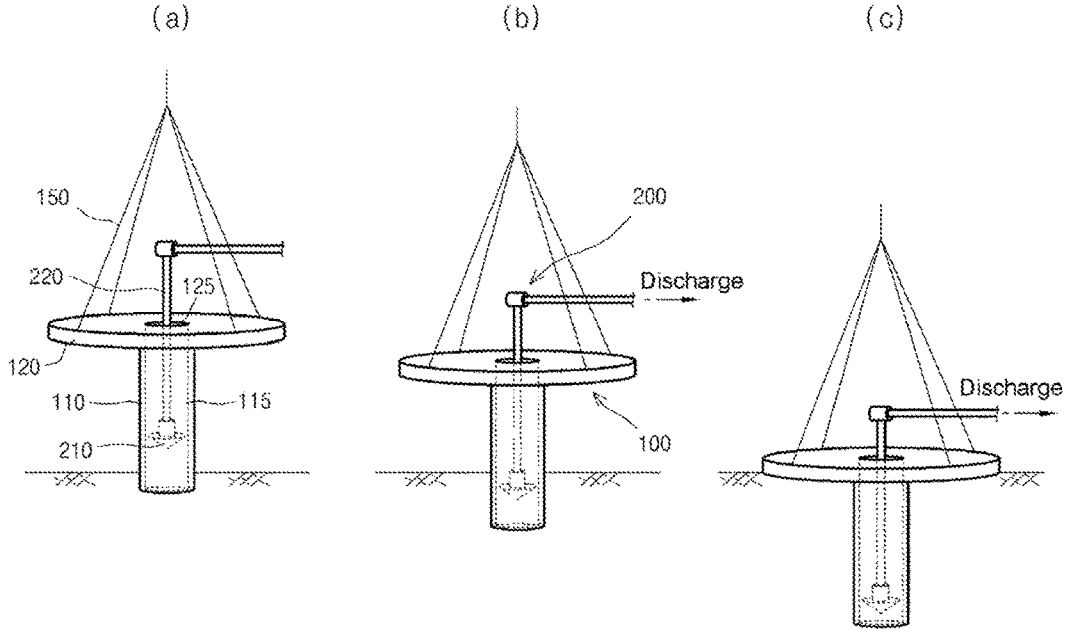
FIG. 3(*a*), FIG. 3(*b*) and FIG. 3(*c*) illustrate a construction method for installing a pile having a large flange in accordance with an embodiment of the present invention.

FIG. 3 illustrates a construction method for installing a pile having a large flange in accordance with an embodiment of the present invention.

Illustrated in FIG. 3 are a pile 100 having a large flange, an open hole 125, an inner space 115, a pile portion 110, a flange portion 120, wires 150, an excavating pump apparatus 200, an excavation head 210 and outlet conduit 220.

Referring to the drawing marked with (a) in FIG. 3, the pile 100 having a large flange is landed on the seabed in which the pile 100 is to be installed. Here, the pile 100 may be allowed to stay vertical by use of the wires 150.

The flange portion 120 formed at a top portion of the pile 100 may have the open hole 125, of which the diameter is identical to that of the inner space 115 of the pile portion 110, formed therein, allowing the excavation head 210 of the excavating pump apparatus 200 to be inserted into the inner space 115 of the pile portion 110. Here, in order to allow the excavation head 210 to be inserted easily, the diameter of the excavation head 210 may be smaller than those of the inner space 1115 and the open hole 125.

Referring to the drawing marked with (b) in FIG. 3, the excavating pump apparatus 200 is driven to excavate the seafloor ground underneath the pile portion 110, and seafloor sediments liquefied as a result of disturbing the seafloor ground during the excavation are discharged out of the pile 100 through the outlet conduit 220 using a pump.

In this process, the weight of the pile 100 itself allows a bottom end of the pile portion 110 to begin to sink into the seafloor ground that is agitated by the excavation.

By repeating the excavation and discharge of the seafloor sediments while positioning the excavation head 210 at a depth corresponding to an injection depth of the pile portion 110, the pile 100 may be completely driven into the seafloor ground (see (c) of FIG. 3).

In such a case, a bottom surface of the flange portion 120 makes contact with the seabed, allowing the load applied to the pile 100 to be dispersed through the seabed and preventing the pile 100 from being tilted by partial load.

According to the conventional installation method using the suction pile, the seawater is extracted over the sealed-type pile having a seawater outlet hole to allow the pile to be sunk by its own weight, and pile driving processes have to be additionally performed in order to achieve further injection. However, according to the present embodiment, the excavation head is inserted into the pile to perform excavation and discharge the seafloor sediments simultaneously, allowing installation of the pile in a short time without additional pile driving processes.

Hereinafter, the excavating pump apparatus used for installation of the pile will be described in detail.

Figure 4:
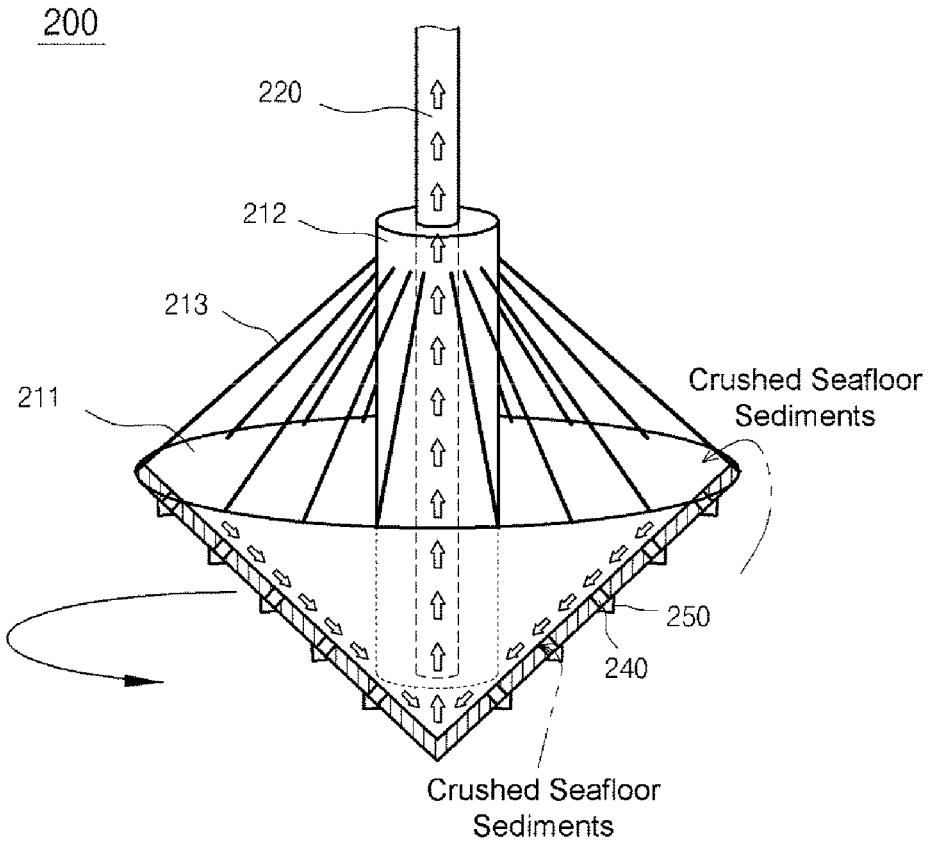
FIG. 4 is a perspective view showing an excavation head included in the excavating pump apparatus in accordance with an embodiment of the present invention.
Figure 5:
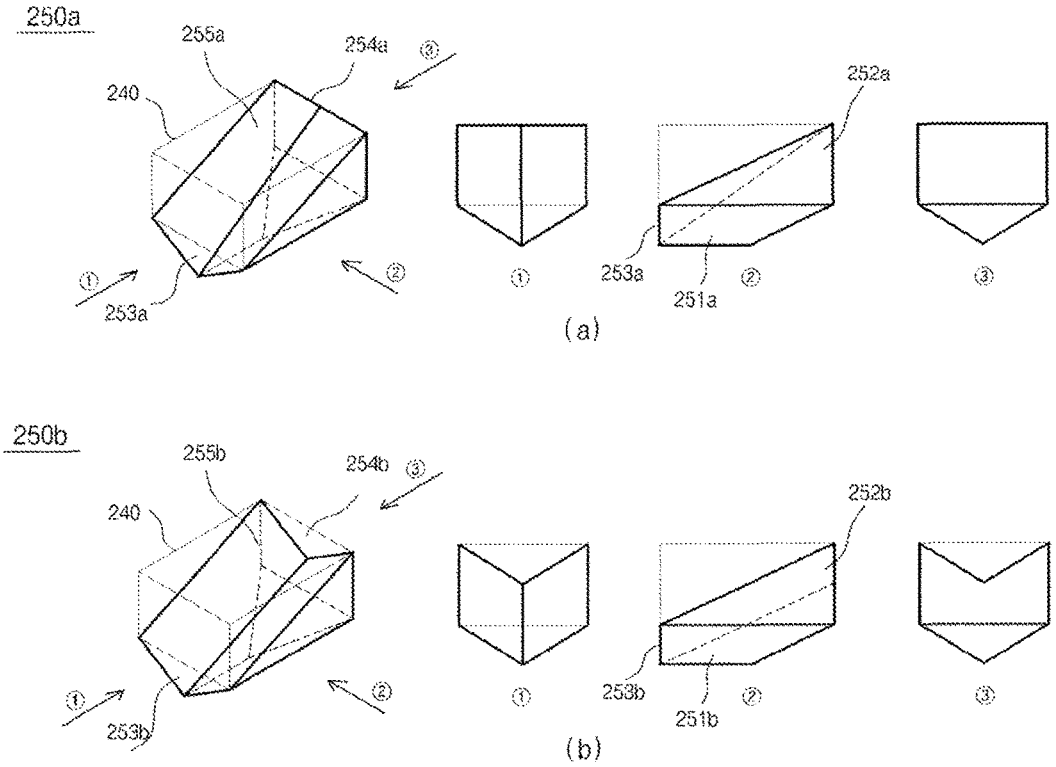
FIG. 5(*a*) and FIG. 5(*b*) show various embodiments of an excavation bit installed on the excavation head.
Figure 6:
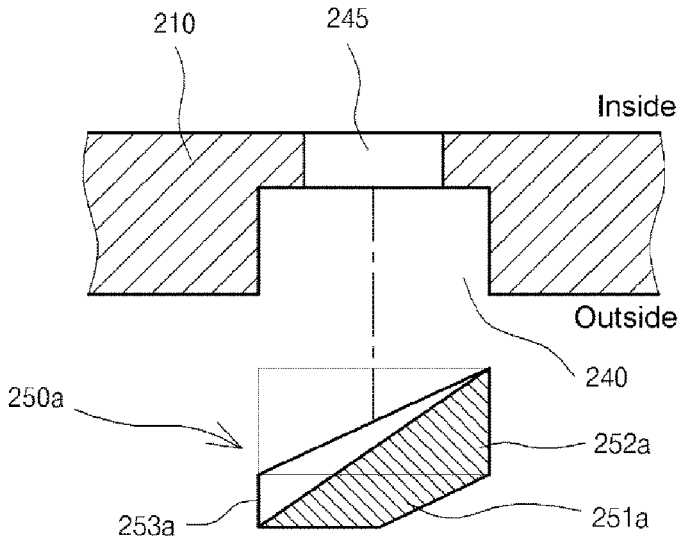
FIG. 6(*a*) and FIG. 6(*b*) are cross-sectional views showing how the excavation bit is installed.
Figure 6:
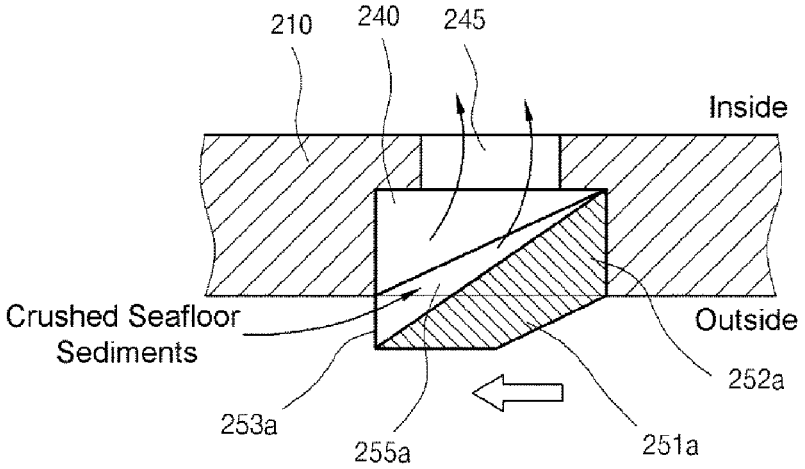

FIG. 4 is a perspective view showing an excavation head included in the excavating pump apparatus in accordance with an embodiment of the present invention. FIG. 5 shows various embodiments of an excavation bit installed on the excavation head. FIG. 6 is a cross-sectional view showing how the excavation bit is installed. Shown on the right side of FIG. 5 are views of the perspective view on the left side seen from ①, ② and ③ directions.

Illustrated in FIG. 4 to FIG. 6 are excavating pump apparatus 200, excavation head 210, head frame 211, installation groove 240, excavation bit 250, 250*a*, 250*b*, center tube 212, outlet conduit 220, bracing 213, inlet hole 245, excavating portion 351*a*, 251*b*, fixing portion 252*a*, 252*b*, excavating hole 253*a*, 253*b*, exit 254*a*, 254*b* and inflow space 255*a*, 255*b*.

The excavating pump apparatus 200 in accordance with an embodiment of the present invention has an excavation head inserted in a pile that has a large-diameter circular flange formed with an opening hole having a same diameter as a body of the pile, as described above. Accordingly, the excavating pump apparatus 200 can simultaneously excavate the seafloor ground and discharge seafloor sediments crushed by excavation out of the pile through a pump operation, allowing the pile to be installed firmly in the seafloor ground in a short time.

The excavating pump apparatus 200 in accordance with an embodiment of the present invention includes the excavation head 210, the outlet conduit 220 and a pump (not shown).

The excavation head 210 includes the head frame 211, which has the shape of a cone of which an inside is hollow, and the center tube 212.

As the head frame 211 has a plurality of excavation bits 250 installed on a surface thereof, the seafloor sediments can be agitated, and the soft rocks can be crushed, by rotating the head frame 211.

As the seafloor sediments are crushed, the excavation bits 250 allows the crushed seafloor sediments to be flowed into the head frame 211 through the excavating hole 253. The excavation bits 250 will be described later in more detail.

The crushed seafloor sediments that are not flowed into the head frame 211 by the excavation bits 250 may be pushed up to a top portion of the head frame 211 and then may drop into the head frame 211 through a top surface thereof. In such a case, the seafloor sediments may be too big for a smooth operation of the apparatus, and thus there may be a sediment-filtering net (not shown) installed on the top surface of the head frame 211 in order to keep the sediments greater than a predetermined size from entering the head frame 211.

The center tube 212 is formed to be hollow therein so as to be connected with the outlet conduit 220, allowing the seafloor sediments gathered inside the head frame 211 to be moved upward and discharged through the outlet conduit 220 by the operation of the pump.

The center tube 212 may be supported by a predetermined support fixture (not shown) to be vertically fixed while the seafloor sediments are not hindered from being gathered at a bottom portion inside the head frame 211.

Since the center tube 212 and the head frame 211 are fixed to each other, the center tube 212 rotates when the head frame 211 rotates. Nonetheless, regardless of this rotation, the hollow tube inside the center tube 212 is constantly connected with the outlet conduit 220, and thus the seafloor sediments can be discharged without interruption.

Moreover, in the present embodiment, the structural rigidity between the head frame 211 and the center tube 212 may be augmented by the bracing 213, of which a top portion is attached to the center tube 212 and a bottom portion is attached to a boundary of the top surface of the head frame 211. The bracing 213 may have a frame structure that also allows the seafloor sediments pushed up to the top portion of the head frame 211 to be readily flowed into the head frame 211.

The bracing 213 may be substituted with a case having an inlet formed on a surface thereof.

Various shapes of excavation bits 250 are illustrated in FIG. 5.

In FIG. 5, the rectangular parallelepiped shape shown in virtual lines is the installation groove 240 formed on an outer surface of the head frame 211 for insertion of the excavation bits.

Illustrated in the section marked with (a) in FIG. 5 is an excavation bit 250*a* in accordance with a first embodiment.

Referencing from the installation groove 240, the excavation bit 250*a* is divided into the excavating portion 251*a*, which is protruded out of the installation groove 240 to perform crushing, and the fixing portion 252*a*, which is for fixing the excavation bit 250*a* in the installation groove 240.

The excavating portion 251*a* has an entrance (excavating hole 253*a*), which is similar to a V-shaped carving knife, and provided between the excavating portion 251*a* and the fixing portion 252*a* is the inflow space 255*a*, which allows the crushed seafloor sediments flowed in through the excavating hole 253*a* to easily flow into the head frame 211.

The inflow space 255*a* has the exit 254*a* that has the shape of a straight line. Accordingly, as slopes on either side of the V-shaped groove become gradually slower from the entrance to the exit, the crushed sediments can be easily flowed into the head frame 211.

Illustrated in the section marked with (b) in FIG. 5 is an excavation bit 250*b* in accordance with a second embodiment.

Referencing from the installation groove 240, the excavation bit 250*b* is divided into the excavating portion 251*b*, which is protruded out of the installation groove 240 to perform crushing, and the fixing portion 252*b*, which is for fixing the excavation bit 250*b* in the installation groove 240.

The excavating portion 251*b* has an entrance (excavating hole 253*b*), which is similar to a V-shaped carving knife, and provided between the excavating portion 251*b* and the fixing portion 252*b* is the inflow space 255*b*, which allows the crushed seafloor sediments flowed in through the excavating hole 253*b* to easily flow into the head frame 211.

In this embodiment, as the exit 254*b* is also V-shaped like the entrance, the inflow space 255*b* is structured in such a way that the V-shaped groove is extended, and thus a greater amount of crushed sediments can be received.

Illustrated in FIG. 6 are cross-sectional views of the excavation bit 205*a* in accordance with the first embodiment before and after installation in the head frame 211.

The head frame 211 has the rectangular parallelepiped shape of the installation groove 240 formed on the outer surface thereof, and may have a corresponding inlet hole 245 formed in an inner surface thereof. Although it is illustrated that the inlet hole 245 is formed at a middle portion of the installation groove 240, this is merely one embodiment, and it is possible that, depending on the embodiment, the inlet hole 245 is formed at an edge of the installation groove 240.

The excavation bit 250*a* shown in FIG. 5 may be inserted and installed in the installation groove 240. Although it is illustrated that the excavation bit 250*a* in accordance with the first embodiment is installed, this is merely one embodiment, and it is also possible that the excavation bit 250*b* in accordance with the second embodiment is installed.

When installing the excavation bit 250*a*, the fixing portion 252*a* of the excavation bit 250*a* is fitted into the installation groove 240. The fixing portion 252*a* may be fixed using various coupling means, such as, for example, bolt coupling, which are well known to those of ordinary skill in the art and thus will not be described herein.

When the excavation bit 250*a* is fitted into the installation groove 20, the portion to which the excavation bit 205*a* is coupled is formed with a kind of channel connecting the inside and the outside of the head frame 211 with each other. This is because, as described earlier, the excavating portion 251*a* of the excavation bit 250*a* protruding out of the installation groove 240 has the V shape, and thus the crushed seafloor sediments can be flowed in through the excavating hole 253*a* located at the entrance side, moved along the inflow space 255*a*, and flowed into the head frame 211 through the inlet hole 245 formed at the exit side.

In other words, the excavation bit 250*a* in accordance with the present embodiment performs the primary role of crushing the seafloor sediments at the outside of the head frame 211 and the secondary role of channeling the crushed seafloor sediments to be flowed into the head frame 211.

Owing to this structure, the excavation bit 250*a* can be easily replaced in block units according to the level of damage or wear.

The installation groove 240 for installing the excavation bit 250*a* may be spirally arranged in plurality on the outer surface of the head frame 211 or arranged in plurality corresponding to a generator arranged at regular intervals, thereby excavating the seafloor sediments uniformly.

Figure 7:
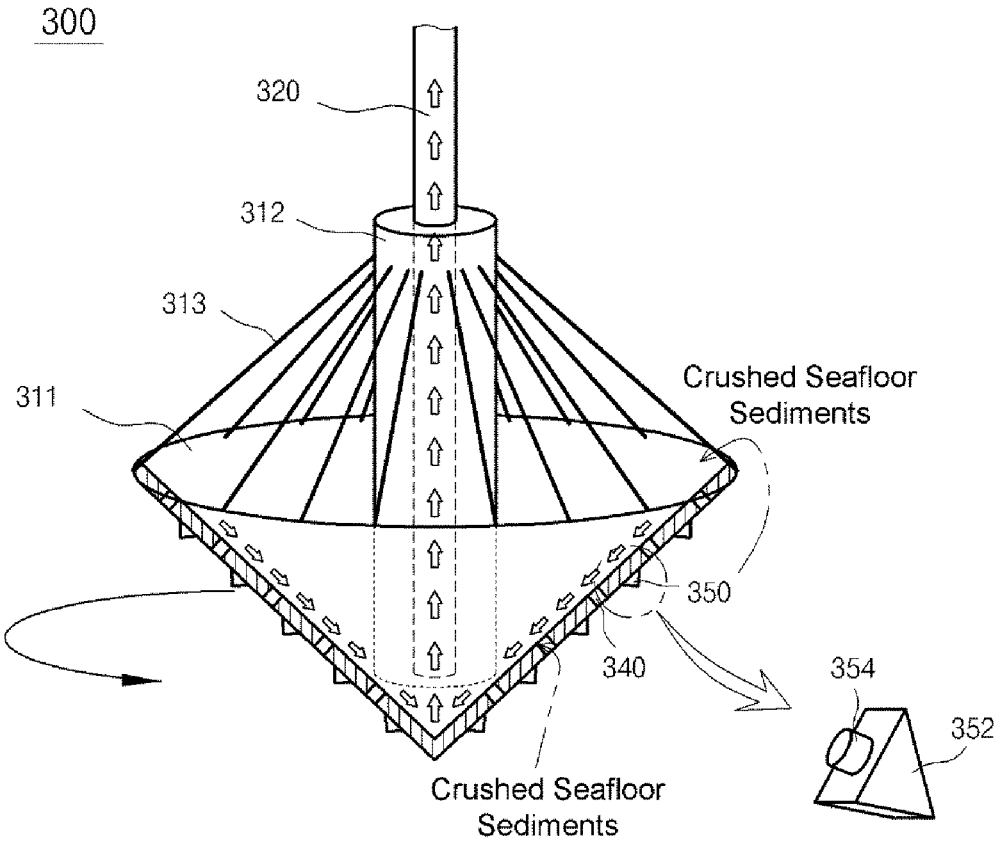
FIG. 7 is a perspective view showing an excavation head included in the excavating pump apparatus in accordance with another embodiment of the present invention.

FIG. 7 is a perspective view showing an excavation head included in the excavating pump apparatus in accordance with another embodiment of the present invention.

Illustrated in FIG. 7 are excavating pump apparatus 300, excavation head 310, head frame 311, center tube 312, outlet conduit 320, bracing 313, inlet hole 340, excavation bit 350, bit body 352 and fitting protrusion 354.

The head frame 311, the center tube 312, the bracing 313 and the outlet conduit 320 of the excavating pump apparatus 300 illustrated in FIG. 7 are identical with the head frame 211, the center tube, the bracing 213 and the outlet conduit 320 of the excavating pump apparatus 200 illustrated in FIG. 4 and thus will not be described redundantly herein.

According to the present embodiment, unlike FIG. 4, the excavation bit 350 having the crushing function only and the inlet hole 340 for allowing the crushed sediments to be flowed in are not integrally formed but are separately provided.

The excavation bit 350 includes the bit body 352, which is protruded out of an outer surface of the head frame 311 and performs the crushing function, and the fitting protrusion 354, which is protruded on one surface of the bit body 352 and is configured to be fitted into a fitting groove (not shown) formed on the outer surface of the head frame 311. Here, the fitting groove may be recessed in between the inlet holes 340.

The excavation bit 350 may be strongly coupled by the fitted coupling and may be easily replaced when worn out.

Figure 8:
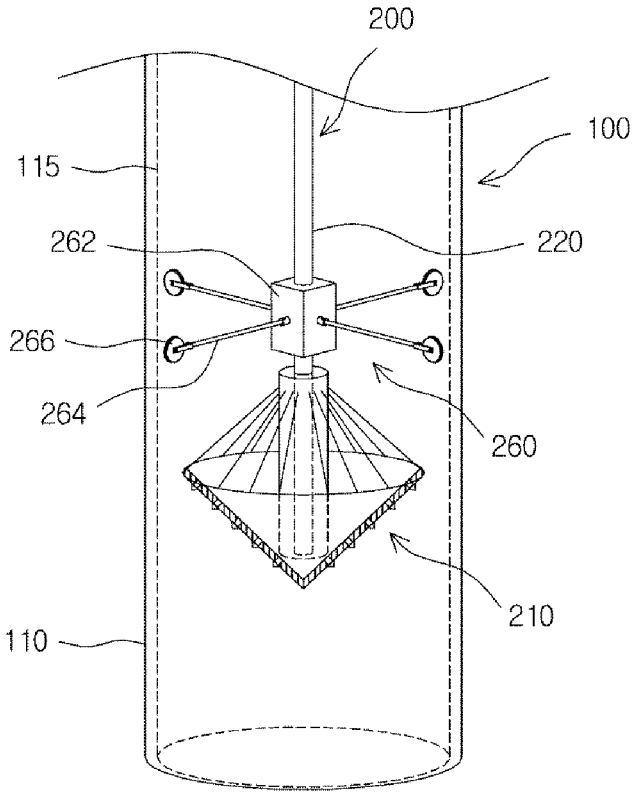
FIG. 8 is a perspective view showing a support frame included in the excavating pump apparatus in accordance with an embodiment of the present invention.
Figure 9:
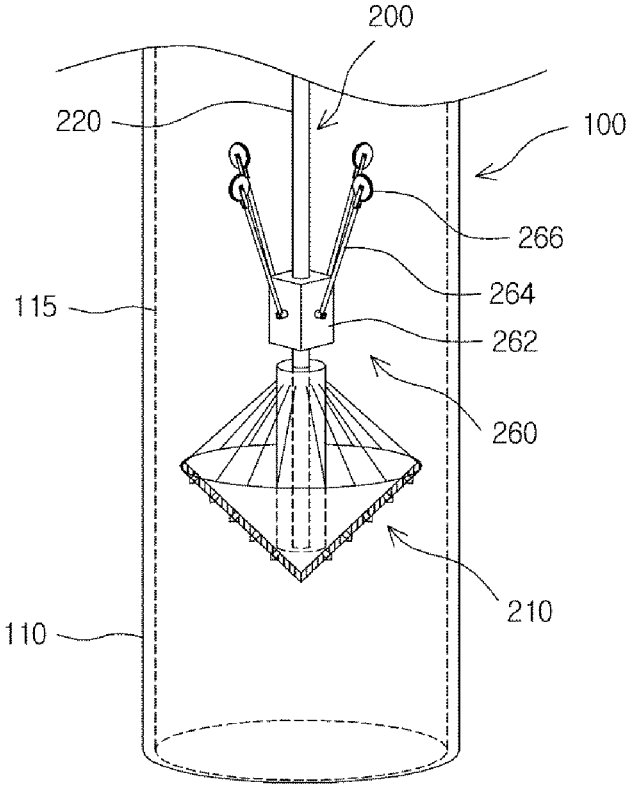
FIG. 9 is a perspective view showing how the support frame shown in FIG. 8 is folded.

FIG. 8 is a perspective view showing a support frame included in the excavating pump apparatus in accordance with an embodiment of the present invention, and FIG. 9 is a perspective view showing how the support frame shown in FIG. 8 is folded.

Referring to FIG. 8 and FIG. 9, the excavating pump apparatus 200 in accordance with an embodiment of the present invention may further include a support frame 260, which is coupled to the excavation head 210 or the outlet conduit 220 and is configured to be expanded in radial directions of the excavation head 210 or the outlet conduit 220 to press an inner circumferential surface of the pile 100 so as to restrict a horizontal movement of the excavation head 210 in the inner space 115 of the pile 100.

Although the excavating pump apparatus 200 in accordance with an embodiment of the present invention described above with reference to FIG. 3 to FIG. 6 is illustrated in FIG. 8 and FIG. 9, this is only an illustration of one embodiment, and it shall be appreciated that the illustrated embodiment may be substituted with the excavating pump apparatus 300 in accordance with another embodiment of the present invention described above with reference to FIG. 7.

As described earlier, the diameter of the inner space 115 of the pile 100 is greater than the diameter of the excavation head 210 such that the excavation head 210 can be easily inserted into the inner space 115 of the pile 100. Accordingly, the excavation head 210 disposed in the inner space 115 of the pile 100 and the outlet conduit 220 connected to the excavation head 210 can move in radial directions of the pile 100 within the pile 100, possibly deteriorating the operational accuracy of the excavation head 210 while crushing the seafloor sediments.

Specifically, the excavation head 210 may be moved in horizontal directions within the pile 100 by a reaction force given to the excavation head 210 by the ground while the seafloor sediments are crushed, and this movement of the excavation head 210 may not only deteriorate the accuracy of the excavating position and the efficiency of excavation but also cause a damage to the inner circumferential surface of the pile 100.

As illustrated in FIG. 8, the support frame 260 may be disposed in the inner space 115 of the pile 100 to press against the inner circumferential surface of the pile 100 and may transfer pressure to the excavation head 210 and the outlet conduit 220 such that the excavation head 210 and the outlet conduit 220 maintain fixed positions within the inner space 115 of the pile 100. Accordingly, the excavation head 210 can perform excavation at a center portion in the pile 100.

Although FIG. 8 illustrates that the support frame 260 is coupled to the outlet conduit 220, it is also possible that the support frame 260 is coupled to the excavation head 210, in which case the support frame 260 may be configured to rotate together with the excavation head 210 when the excavation head 210 is driven.

Meanwhile, the support frame 260 may include a plurality of rods 264, which are rotatably coupled to the excavation head 210 or the outlet conduit 220 for opening or folding from the excavation head 210 or the outlet conduit 220, and a roller portion 266, which is coupled to an end of each rod 264 and makes contact with the inner circumferential surface of the pile 100.

The plurality of rods 264 may be directly coupled to one side of the excavation head 210 or the outlet conduit 220, it is also possible that the plurality of rods 264 are indirectly coupled to the excavation head 210 or the outlet conduit 220 by being coupled to a base 262 coupled to the excavation head 210 or the outlet conduit 220.

The plurality of rods 264 may be rotatably coupled to the excavation head 210 or the outlet conduit 220 and opened to be expanded radially, as shown in FIG. 8, or to be folded, as shown in FIG. 9. Since it is sufficient as long as the support frame 260 supports the excavation head 210 or the outlet conduit 220 only while the excavation head 210 is driven, the support frame 260 may be unfolded to press the inner circumferential surface of the pile 100 after the excavation head 210 is completely inserted into the pile 100, and the support frame 260 may be folded to be inserted into the pile 100 such that the excavation head 210 is easily inserted into the inner space 115 of the pile 100.

The roller portion 266 is coupled to one end of each rod 264 to make contact with the inner circumferential surface of the pile 100. Although the excavation head 210 needs to be restrictively moved in radial directions within the pile 100 in order to improve the positional accuracy of excavation, the excavation head 210 may need to be moved in a depth direction of the pile 100 as the excavation becomes deeper.

Specifically, the excavation head 210 moves deeper into the ground while crushing the seafloor sediments, and the pile 100 is injected by its own weight into the seafloor ground that is agitated by the excavation. Here, the excavation head 210 and the pile 100 may move in the same direction but in different speeds, causing a relative movement of the excavation head 210 and the pile 100. The roller portion 266 facilitates a movement of the excavation head 210 and the outlet conduit 220 connected to the excavation head 210 with respect to the pile 100 while maintaining the contact state of the excavation head 210 and the outlet conduit 220 to the inner circumferential surface of the pile 100.

Figure 10:
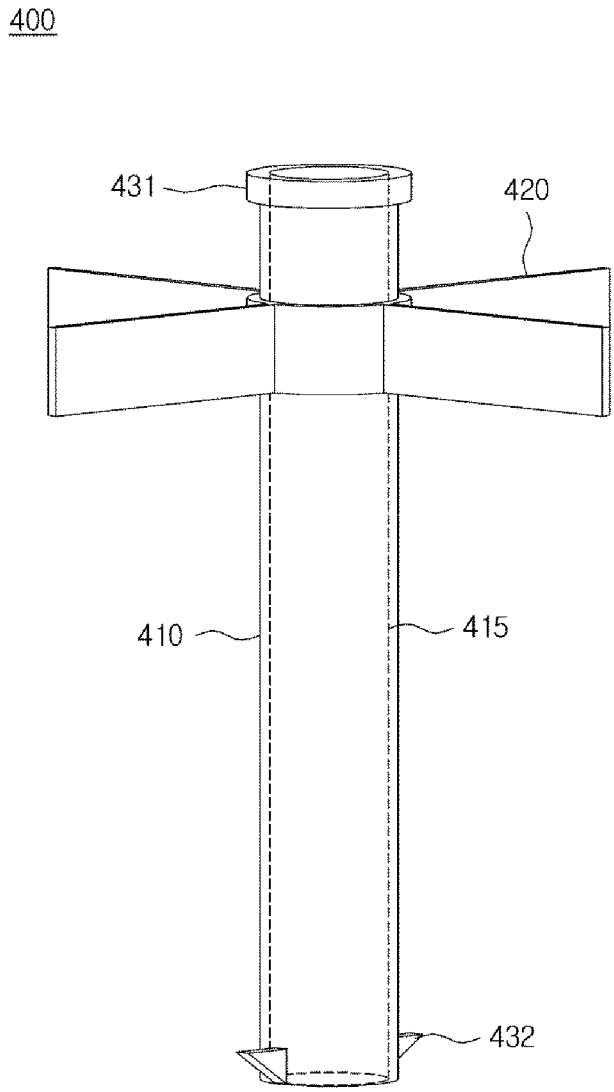
FIG. 10 is a perspective view of a pile having a support plate in accordance with another embodiment of the present invention.
Figure 11:
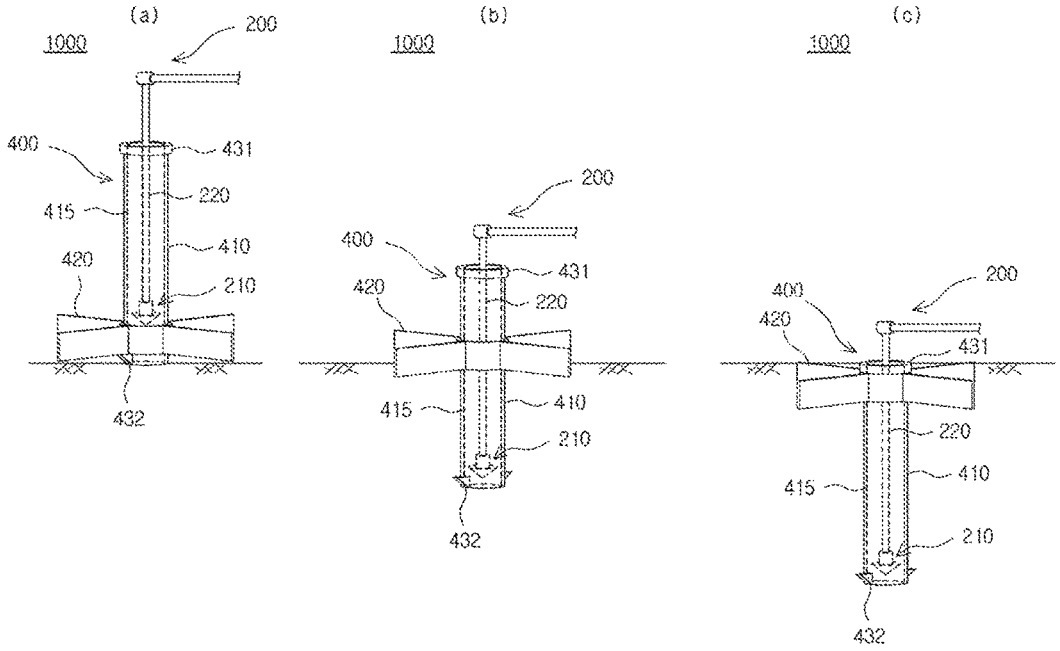
FIG. 11(*a*), FIG. 11(*b*) and FIG. 11(*c*) illustrate an apparatus and a method for installing the pile shown in FIG. 10.

FIG. 10 is a perspective view of a pile having a support plate in accordance with another embodiment of the present invention, and FIG. 11 illustrates an apparatus and a method for installing the pile shown in FIG. 10.

Referring to FIG. 10, a pile 400 in accordance with another embodiment of the present invention includes a pile portion 410 in the shape of a circular tube, a support plate 420 and stopper portions 431, 432.

The pile portion 410, which is a portion corresponding to a body of the pile 400 in accordance with the present embodiment, has a hollow space 415, which is extended in a lengthwise direction, formed therein, and the excavating pump apparatus may be inserted into the hollow space 415.

The support plate 420 is formed with a hollow space into which the pile portion 410 is inserted and is radially extended from the pile portion 410 such that a contact area in the seafloor ground is increased when injected into the seafloor ground. The pile injected into the seafloor ground can have a greater resistance to a pull-out force exerted to the pile when the pile has a greater contact area with the surrounding ground. By being injected into the seafloor ground with the pile portion 410, the support plate 420 can increase the overall contact area of the pile 400.

The stopper portions 431, 432 are protruded at either lengthwise end of the pile portion 410 so as to prevent the support plate 420 from being detached from the pile portion 410. A pull-out supportive force of the entire pile 400 can be improved only when the support plate 420 stays coupled with the pile portion 410. As the pile portion 410 is inserted into the hollow space formed in the support plate 420, the support plate 420 is movable in the lengthwise direction of the pile portion 410. However, due to the stopper portions 431, 432 formed at either end of the pile portion 410, the support plate 420 can be restricted from breaking away from the pile portion 410, that is, being physically released from the pile portion 410.

FIG. 11 illustrates a pile installation apparatus 1000 in accordance with an embodiment of the present invention, and illustrates a method for injecting the pile 400 having the support plate 420 shown in FIG. 10.

Referring to the drawing marked with (a) in FIG. 11, the pile installation apparatus 1000 in accordance with the present embodiment includes a pile 400, which has a hollow space 415 formed therein and is configured to be injected into the seafloor ground, and an excavating pump apparatus 200, which may be inserted in the hollow space 415 formed inside the pile 400 so as to inject the pile 400 into the seafloor ground. Here, the excavating pump apparatus may be the excavating pump apparatus 200, 300 described above with reference to FIG. 3 to FIG. 7. Moreover, the pile may be the pile 100 having the large flange 120 illustrated in FIG. 2, the pile 400 having the support plate 420 illustrated in FIG. 10, or any one of various possible forms and shapes of pile.

Described hereinafter are the pile installation apparatus 1000 including the pile 400 illustrated in FIG. 10 and the excavating pump apparatus 200 described with reference to FIG. 3 to FIG. 6 and a method for installing the pile 400, and any description that is redundant with the features described with reference to FIG. 2 to FIG. 7 will be provided herein.

As illustrated in the drawing marked with (a) in FIG. 11, the pile 400 having the support plate 420 is landed on the seafloor surface. Here, the support plate 420 is placed at a lower end of the pile portion 410 by its own weight, and maintains a state of being in contact with a stopper portion 432 protruded at the lower end of the pile portion 410.

As illustrated in the drawing marked with (b) in FIG. 11, once the excavating pump apparatus 200 is inserted and driven in the hollow space 415 formed inside the pile 400, the lower end of the pile portion 410 is injected, by its own weight, into the seafloor ground that is agitated by the excavation head 210. Here, the support plate 420 of the pile 400 is disposed on the seafloor surface.

As the excavation head 210 continues with the excavation operation and an upper portion of the pile portion 410 is injected into the seafloor ground, a stopper portion 431 formed at an upper end of the pile portion 410 becomes to be pressed against the support plate 420. As a result, the support plate 420 is injected into the seafloor ground together with the pile portion 410, and may be completely injected into the seafloor ground, as shown in the drawing marked with (c) in FIG. 11.

The support plate 420 stays coupled with the pile portion 410 when being injected into the seafloor ground, thereby allowing the entire pile 400 to increase the contact area with the surrounding ground. As a result, it is possible to improve the supporting force of the pile 400 against the pull-out force exerted to the pile 400.

Figure 12:
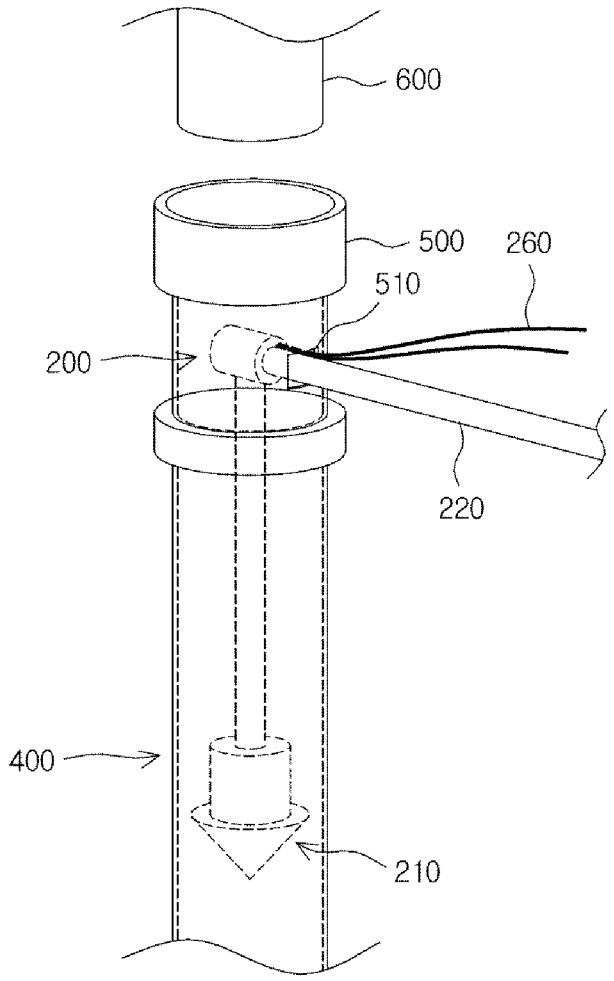
FIG. 12 is a perspective view showing the pile installation apparatus including a pile driving socket.
Figure 13:
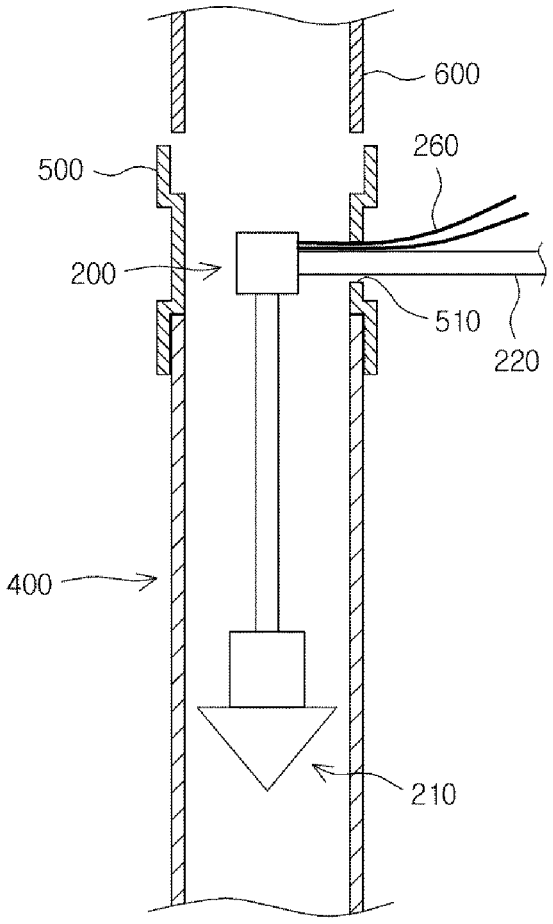
FIG. 13 is a cross-sectional view \showing the pile illustrated in FIG. 12.

FIG. 12 is a perspective view showing the pile installation apparatus including a pile driving socket, and FIG. 13 is a cross-sectional view \showing the pile illustrated in FIG. 12.

While the pull-out supportive force of the pile may be improved by increasing the overall area of the pile, an push-down force, i.e., the force required for injecting the pile into the ground, may be also increased. Accordingly, a greater force may be required in order to inject the pile, and thus the injection of the pile may be facilitated by additionally introducing a pile driving process.

As illustrated in FIG. 12 and FIG. 13, the pile installation apparatus 1000 in accordance with the present embodiment may further include a pile driving socket 500 installed at the upper end of the pile 400 so as to facilitate further injection of the pile 400 by pile-driving. Here, the pile driving socket 500 may have an opening 510 formed at a lateral surface thereof, wherein the outlet conduit 220 of the excavating pump apparatus passes through the opening 510.

By including the pile driving socket 500, the pile installation apparatus 1000 in accordance with the present embodiment can perform an additional pile driving process in addition to having the pile 400 injected by the excavating pump apparatus 200. A pile driver 600 may exert the push-down force to the pile 400 directly or indirectly by hitting the pile driving socket 500.

The pile driving socket 500 may be formed independently from the pile driver 600 and the pile 400, or may be formed integrally with the pile driver 600 or the pile 400. The opening 510 formed at the lateral surface of the pile driving socket 500 may provide a channel for not only the outlet conduit 220 but also various cables 270. Through the cables 270, power required for driving the excavating pump apparatus may be supplied, or signals required for controlling the excavating pump apparatus 200 may be communicated.

Although certain embodiments of the present invention have been described hitherto, it shall be appreciated that various modifications and permutations of the present invention are possible by those who are ordinarily skilled in the art to which the present invention pertains without departing from the technical ideas and scope of the present invention defined by the claims appended below.

The invention claimed is:

1. An excavating pump apparatus, comprising:

an excavation head being inserted into an inner space of a pile through an open hole opening the inner space of the pile and being configured to crush seafloor sediments within the inner space of the pile and allow the crushed seafloor sediments to be flowed therein;

an outlet conduit connected to the excavation head and being a channel for discharging the seafloor sediments flowed into the excavation head to an outside of the pile; and a pump configured to move the seafloor sediments through the outlet conduit by providing a pump pressure to the outlet conduit, wherein the excavation head comprises:

a head frame having a shape of a cone of which an inside is hollow and having a plurality of excavation bits installed on an outer surface thereof, the excavation bits functioning as inflow paths of the seafloor sediments; and a center tube being vertically supported by support fixture in the head frame and having a middle portion penetrated to be connected with the outlet conduit.

2. The excavating pump apparatus of claim 1, further comprising a plurality of bracing or casing, each having a top portion thereof being attached to the center tube and a bottom portion thereof being attached to a boundary of a top surface of the head frame.

3. The excavating pump apparatus of claim 1, wherein the head frame has a plurality of rectangular parallelepiped shaped installation grooves installed on the outer surface thereof, the installation grooves being installed spirally or arranged corresponding to generators arranged at regular intervals, the installation grooves being provided with inlet holes connected with the inside of the head frame, and wherein the excavation bits are inserted and installed in the installation grooves, respectively.

4. The excavating pump apparatus of claim 3, wherein the excavation bits each comprise a fixing portion, being inserted and fixed in the installation grooves, and an excavating portion, being protruded out of the installation grooves, wherein the excavating portion and the fixing portion have an inflow space provided therein, the inflow space having a V-shaped groove formed successively, and wherein the crushed seafloor sediments are flowed in through an excavating hole located at an entrance side, moved along the inflow space, and flowed into the head frame through the inlet hole located at the exit side.

5. The excavating pump apparatus of claim 4, wherein slopes of the excavation bits on either side of the V-shaped groove become gradually slower.

6. The excavating pump apparatus of claim 1, wherein the excavation head comprises:

a head frame having a shape of a cone of which an inside is hollow, having a plurality of inlet holes formed on an outer surface thereof, the inlet holes functioning as inflow paths of the seafloor sediments, and having a plurality of replaceable excavation bits protruded on the outer surface thereof, the excavation bits being configured to perform a crushing function; and a center tube being vertically supported by support fixture in the head frame and having a middle portion penetrated to be connected with the outlet conduit.

7. The excavating pump apparatus of claim 6, wherein a plurality of fitting grooves are recessed in between the inlet holes, the fitting grooves being formed spirally or arranged corresponding to generators arranged at regular intervals, and wherein a fitting protrusion protruded on one surface of a bit body of each of the excavation bits is fitted into the fitting grooves.

8. The excavating pump apparatus of claim 1, further comprising a support frame being coupled to the excavation head or the outlet conduit and configured to be expanded in radial directions of the excavation head or the outlet conduit to press an inner circumferential surface of the pile so as to restrict a horizontal movement of the excavation head in the inner space of the pile.

9. The excavating pump apparatus of claim 8, wherein the support frame comprises:

a plurality of rods being rotatably coupled to the excavation head or the outlet conduit for opening or folding from the excavation head or the outlet conduit; and a roller portion being coupled to an end of each rod and making contact with the inner circumferential surface of the pile.

10. The excavating pump apparatus of claim 1, wherein the pile is configured to be inserted into the seafloor sediments before the excavation head crushes the seafloor sediments.

11. A pile installation apparatus, comprising:

a pile having a hollow space formed therein and configured to be injected into a seafloor ground; and an excavating pump apparatus being inserted into the hollow space so as to allow the pile to be injected into the seafloor ground, wherein the excavating pump apparatus comprises:

an excavation head configured to crush seafloor sediments within the pile and allow the crushed seafloor sediments to be flowed therein;

an outlet conduit connected to the excavation head and being a channel for discharging the seafloor sediments flowed into the excavation head to an outside of the pile; and a pump configured to move the seafloor sediments through the outlet conduit by providing a pump pressure to the outlet conduit, wherein the excavation head comprises:

a head frame having a shape of a cone of which an inside is hollow and having a plurality of excavation bits installed on an outer surface thereof, the excavation bits functioning as inflow paths of the seafloor sediment; and a center tube being vertically supported by support fixture in the head frame and having a middle portion penetrated to be connected with the outlet conduit.

12. The pile installation apparatus of claim 11, wherein the pile comprises:

a pile portion having a shape of a circular tube; and a flange portion formed at an upper portion of the pile portion so as to disperse a load exerted to the pile portion to a seafloor surface.

13. The pile installation apparatus of claim 11, wherein the pile comprises:

a pile portion having a shape of a circular tube;

a support plate being formed with a hollow space into which the pile portion is inserted and being radially extended from the pile portion such that a contact area in the seafloor ground is increased when injected into the seafloor ground; and stopper portions being protruded at either lengthwise end of the pile portion so as to prevent the support plate from being detached from the pile portion.

14. The pile installation apparatus of claim 11, further comprising a pile driving socket installed at an upper end of the pile so as to facilitate further injection of the pile by pile-driving, wherein the pile driving socket has an opening formed at a lateral surface thereof, the outlet conduit passing through the opening.

15. The pile installation apparatus of claim 11, wherein the excavation head is configured to crush the seafloor sediments within the hollow space of the pile.

* * * * *